US006135794A

United States Patent [19]

Kwon et al.

[11] Patent Number: 6,135,794

[45] Date of Patent: Oct. 24, 2000

[54] APPARATUS FOR GROUNDING A SIGNAL CABLE

[75] Inventors: Sung-Tae Kwon; Nam-Ill Cho, both of Suwon, Rep. of Korea

[73] Assignee: SamSung Electronics Co., Ltd., Suwon, Rep. of Korea

[21] Appl. No.: 09/399,774

[22] Filed: Sep. 21, 1999

[30] Foreign Application Priority Data

Feb. 13, 1999 [KR] Rep. of Korea ..... 99-5283

[51] Int. Cl.[7] ..... H01R 4/66; H01R 13/648

[52] U.S. Cl. ..... 439/98

[58] Field of Search ..... 439/98, 99, 95, 439/939, 92; 174/51, 65 R, 64

[56] References Cited

U.S. PATENT DOCUMENTS 3,877,112 4/1975 Pestka ..... 24/73 B 4,679,869 7/1987 Watson ..... 439/78

5,746,609 5/1998 Franks ..... 439/92

*Primary Examiner*—Paula Bradley

*Assistant Examiner*—Phuongchi Nguyen

*Attorney, Agent, or Firm*—Robert E. Bushnell, Esq.

[57] ABSTRACT

An apparatus for grounding a cable comprises a holder integrally formed at a predetermined portion of the cable for grounding the cable to the grounding member, a grounding plate integrally mounted to the holder for making contact with the grounding member at the same time that the cable is fixed to the grounding member by the holder, and a clamp by vertically protruding from the grounding plate so as to make contact with the ecdysis portion of the cable, thereby electrically connecting the cable to the grounding plate.

34 Claims, 4 Drawing Sheets

APPARATUS FOR GROUNDING A SIGNAL CABLE

CLAIM OF PRIORITY

This application makes reference to, incorporates the same herein, and claims all benefits accruing under 35 U.S.C. §119 from my application APPARATUS FOR GROUNDING A SIGNAL CABLE filed with the Korean Industrial Property Office on Feb. 13, 1999 and there duly assigned Ser. No. 5283/1999.

BACKGROUND OF THE INVENTION

1. Technical Field

The present invention relates to an apparatus for grounding a signal cable and, more particularly, to an apparatus used to ground a signal cable at the same time that the signal cable is secured to a monitor.

2. Related Art

Apparatuses or devices for grounding a signal cable, such as that connected to a monitor, have several disadvantages.

They are typically too complex in that they require extra tools or parts. They also require multiple assembly steps. Furthermore, they are costly to manufacture.

Therefore, there is a need for a grounding apparatus which overcome these disadvantages.

SUMMARY OF THE INVENTION

Therefore, it is an object of the present invention to provide an apparatus for grounding a signal cable at the same time that the signal cable is fixed to a monitor.

In order to achieve the above object, an apparatus for grounding a single cable comprises: a holder integrally formed at a predetermined portion of the cable for grounding the cable to a grounding member; a grounding plate integrally mounted on the holder and performing a grounding function by making contact with a grounding member at the same time that the cable is secured to the grounding member by the holder; and a clamp protruding integrally from the grounding plate for making contact with the ecdysis portion of the cable, thereby electrically connecting the cable to the grounding plate.

According to the present invention, the holder comprises a coupling recess formed at both respective side surfaces thereof, the coupling recess being inserted into and engaged with the receiving groove of the grounding member so that the cable is secured to the grounding member. The grounding plate has a first vertical portion inserted into the coupling recess, a second vertical portion opposite to the first vertical portion for making contact with an outside surface of the holder, and a horizontal portion for allowing the first and second vertical portions to be integrally connected, thereby being assembled to the holder.

The clamp, which is formed by protruding from the second vertical plate in the cable direction, wraps around the ecdysis portion of the cable. The apparatus further comprises an insulating and contracting tube for preventing the clamp from shorting with other components.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Hereinafter, a preferred embodiment of the present invention will be explained in detail with reference to the accompanying drawings.

Figure 1:
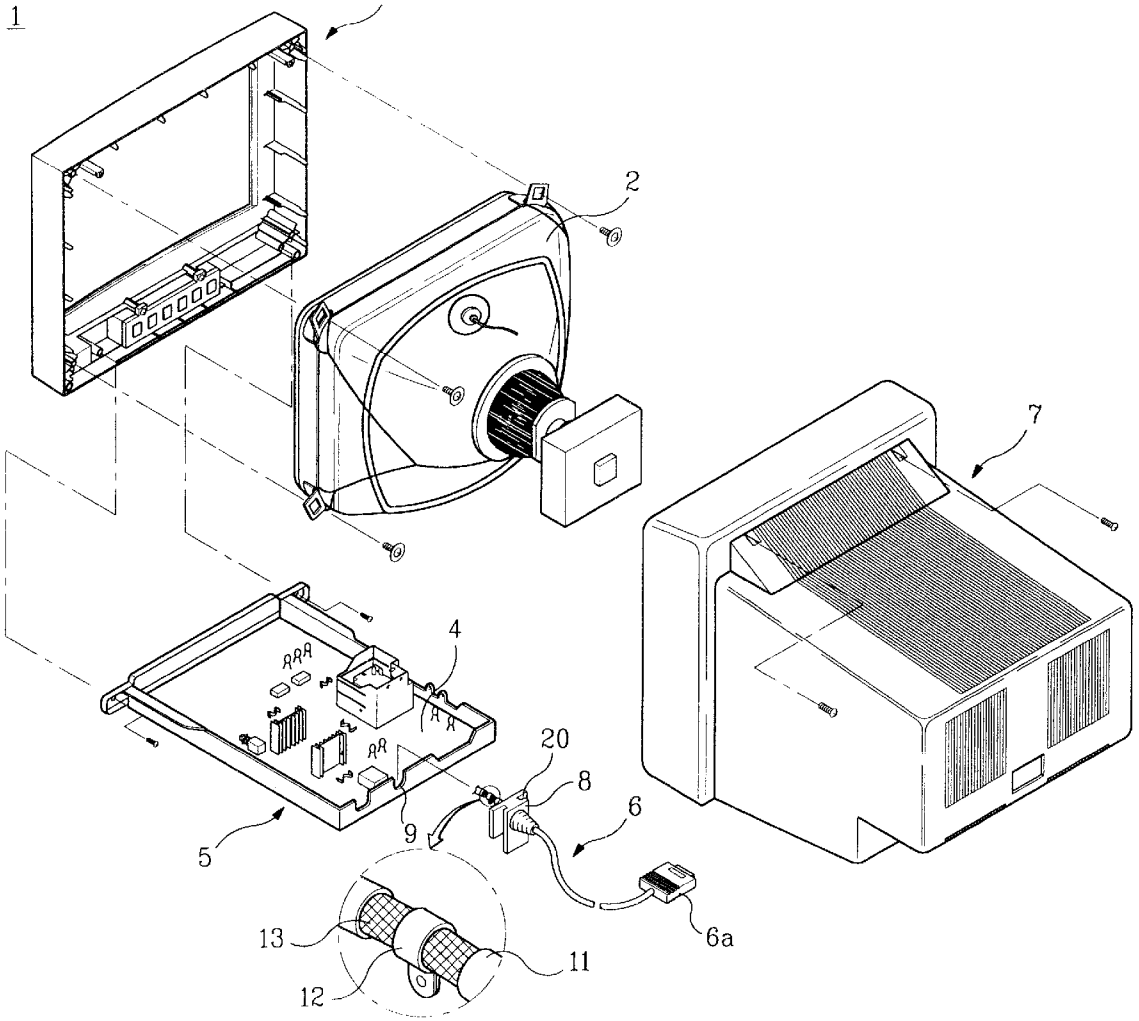
FIG. 1 is a schematic view showing a signal cable connected to a monitor.

FIG. 1 is a schematic view showing a signal cable 6 connected to a monitor 1. As illustrated in FIG. 1, the monitor 1 has a front case 3, a cathode ray tube 2 mounted on the front case 3 for displaying a character or a picture, a rear case 7 integrally assembled to the back of the front case 3 for protecting interior accessories, a printed circuit board 4 (hereinafter, PCB) for electrically controlling the monitor 1, a bottom chassis (grounding member) 5 for securing the PCB 4 to the front case 3, and a signal cable 6 for transmitting a predetermined signal outputted from a computer(not shown) to the PCB 4.

The signal cable 6 comprises a holder 8 formed at a predetermined portion thereof for securing the signal cable 6 to the bottom chassis 5. That is, the holder 8 and the signal cable 6 are manufactured as one body by a molding process. The holder 8 comprises coupling recesses 20 formed downwardly at both side surfaces thereof.

Moreover, the bottom chassis 5 comprises a receiving groove 9 of a U-shape formed at a predetermined portion, more specifically, at the portion securing the signal cable 6 to the bottom chassis 5. Accordingly, the coupling recesses 20 of the holder 8 are received within and engaged with the receiving groove 9 of the bottom chassis 5 so that the signal cable 6 is secured to the bottom chassis 5.

On the other hand, in order to ground the signal cable 6, a cable shield 11 is formed with an ecdysis portion 13 at a predetermined portion thereof. After the ecdysis of the cable shield 11 is formed, a clamp 12 is mounted on the ecdysis portion 13 of the signal cable 6, and the clamp 12 is mounted on the bottom chassis 5 by using a screw(not shown) so as to ground the signal cable 6 to the bottom chassis 5. A contracting tube is inserted into the ecdysis portion (not shown in FIG. 1) of the signal cable 6 for preventing the signal cable 6 from shorting with other components.

However, the above grounding method is complicated. The ecdysis portion 13 is formed from an ecdysis of the cable shield 11, the clamp 12 wraps around the ecdysis portion 13, the clamp 12 is bolted to the bottom chassis 5 by a screw(not shown), and the contracting tube is inserted into the signal cable 6.

Therefore, as described above, the grounding process of the signal cable is carried out separately from the assembly process thereof by securing the cable to the bottom chassis 5.

Furthermore, since tools such as a screw or a clamp are required for grounding the signal cable, the manufacturing cost thereof is increased.

Figure 2:
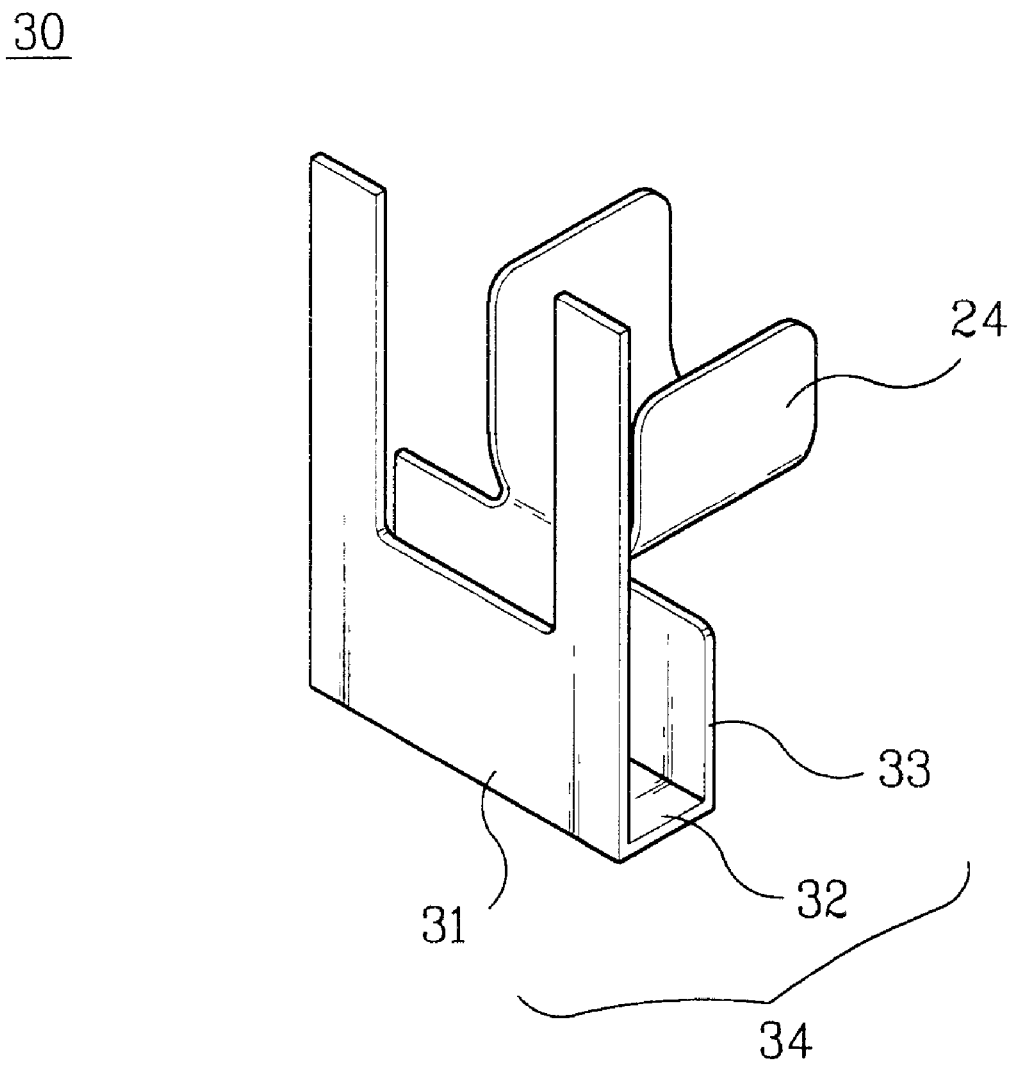
FIG. 2 is a partial enlarged perspective view showing the grounding apparatus of the signal cable according to the present invention.
Figure 3A:
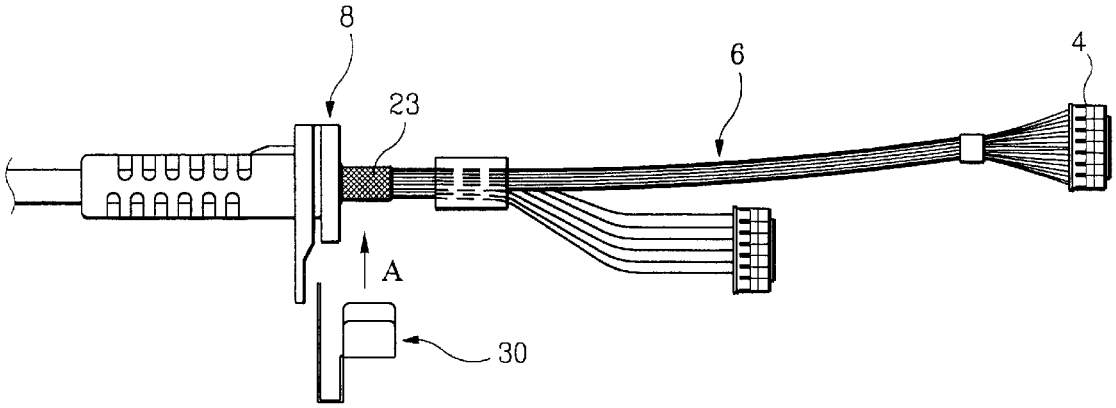
FIGS. 3A, 3B and 3C are views showing an assembly sequence of the grounding apparatus of the signal cable according to the present invention.
Figure 3B:
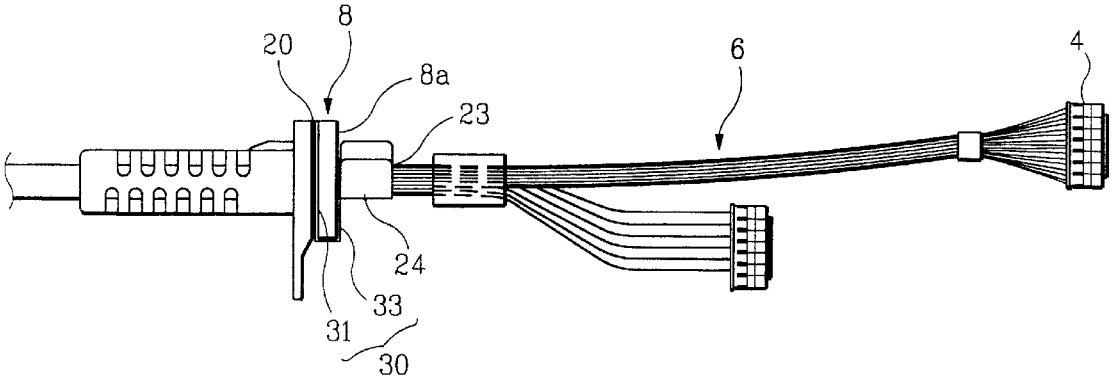
Figure 3C:
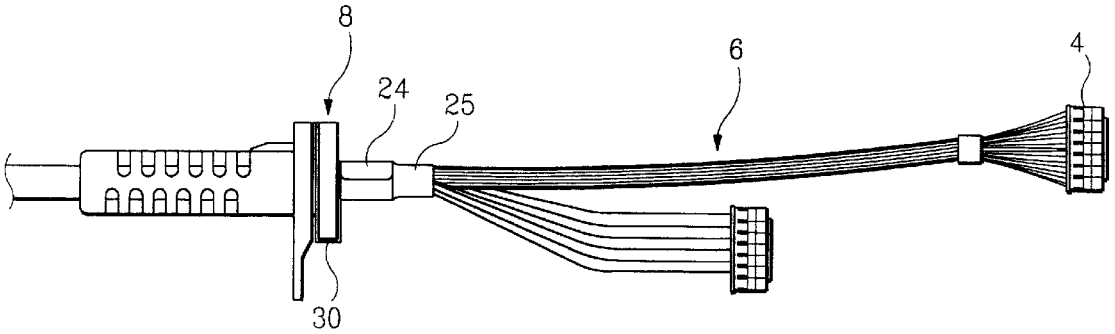
Figure 4:
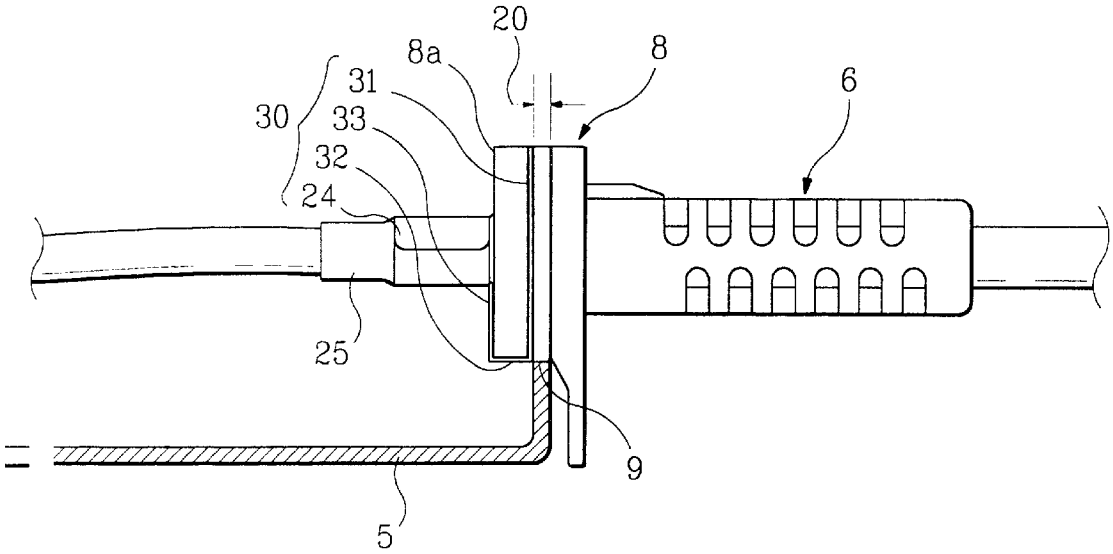
FIG. 4 is a side view showing a grounding state of the grounded apparatus of the signal cable according to the present invention.

FIG. 2 is a partial enlarged perspective view showing the grounding apparatus of the signal cable according to the present invention;

FIGS. 3A, 3B and 3C are views showing an assembly sequence of the grounding apparatus of the signal cable according to the present invention; and FIG. 4 is a side view showing a grounding state of the grounded apparatus of the signal cable according to the present invention.

Since the monitor associated with the grounding apparatus discussed below has the same structure as the monitor illustrated in FIG. 1, the explanation for the monitor will be omitted.

As illustrated in FIG. 4, a signal cable 6 comprises a holder 8 formed integrally at a predetermined position thereof for securing the signal cable 6 to the bottom chassis 5. The holder 8 is manufactured integrally with the signal cable 6 by a molding process, and comprises a downwardly extending coupling recess 20 at each side surface thereof.

As shown in FIG. 2, the grounding apparatus 30 comprises a grounding plate 34 inserted into the coupling recess 20 of FIG. 4, and a clamp 24 protruding from the grounding plate 34 so as to make contact with the ecdysis portion 23 (FIG. 3A) of the signal cable 6.

The grounding plate 34 has a first vertical portion 31 inserted into the coupling recess 20 (FIG. 3), a second vertical portion 33 located opposite to the first vertical portion 31 for making contact with one side surface of the holder 8, and a horizontal portion 32 integrally connecting the first and second vertical portions 31 and 33, respectively. Accordingly, the grounding apparatus 30 is secured to the holder 8 of the signal cable 6, and the holder 8 is inserted into the receiving groove 9 of the bottom chassis 5. At this point, the first vertical portion 31 makes contact with the bottom chassis 5 (FIG. 3) so as to be grounded.

The clamp 24 vertically protrudes from the second vertical portion 33 of the grounding plate 34. The clamp 24 wraps around the ecdysis portion 23 of the signal cable 6. Accordingly, the signal cable 6 is grounded on the bottom chassis 5 by the clamp 24 and the grounding plate 34.

On the other hand, a contracting tube 25 (FIG. 4) is mounted on the signal cable 6 so as to insulate the ecdysis portion 23 of the signal cable 6. Accordingly, the contracting tube 25 wraps around the clamp 24 and the ecdysis portion 23, and it is possible to prevent the ecdysis portion 23 of the signal cable 6 from shorting with other components. Moreover, the contracting tube 25 can be elongated until it reaches the clamp 24.

As described above, in order to secure the signal cable 6 to the bottom chassis 5, the holder 8 of the signal cable 6 is inserted into the receiving groove 9 of the bottom chassis 5 at the same time that the grounding of the signal cable 6 is carried out.

Hereinafter, the operation of the preferred embodiment according to the present invention will be explained in more detail.

As illustrated in FIG. 3A, one end of the signal cable 6 is connected to PCB 4. The signal cable 6 comprises the holder 8 formed at a predetermined position thereof for securing the signal cable 6 to the bottom chassis 5. The signal cable 6 comprises the ecdysis portion 23 for grounding purposes. At this point, the grounding apparatus 30 is mounted on the holder 8 in the direction of an arrow A in FIG. 3A.

FIG. 3B shows a state wherein the grounding apparatus 30 is mounted on the holder 8 of the signal cable 6. That is, the first vertical portion 31 of the grounding apparatus 30 is inserted into the coupling recess 20 of the holder 8, and the second vertical portion 33 makes contact with the one side surface 8a of the holder 8. The clamp 24 wraps around the ecdysis portion 23 of the signal cable 6.

As illustrated in FIG. 3C, after the grounding apparatus 30 is mounted on the holder 8, the clamp 24 is pressed by a tool so that the clamp 24 wraps around the ecdysis portion 23. The contracting tube 25 is inserted into the ecdysis portion 23 of the signal cable 6, thereby preventing the cable 6 from shorting with other components.

FIG. 4 is a side view showing a grounding state of the grounding apparatus 30 of the signal cable 6 according to the present invention. As illustrated therein, the holder 8 (on which the grounding apparatus 30 is mounted) is slidably inserted into the receiving groove 9 of the bottom chassis 5. Accordingly, as a result the coupling recess 20 of the holder 8 is engaged with and received within the receiving groove 9 so that the first vertical portion 31 of the grounding apparatus 30 makes contact with the receiving groove 9.

Accordingly, the signal cable 6 is grounded to the bottom chassis 5 through the clamp 24, the second vertical plate 33, the horizontal portion 32 and the first vertical plate 31.

Therefore, the grounding apparatus has the advantage that grounding of the signal cable is carried out at the same time that the signal cable is secured to the bottom chassis.

Furthermore, since tools (such as a screw) are not needed for the assembly process thereof, the manufacturing cost is decreased.

While the present invention has been particularly shown and described with reference to a particular embodiment thereof, it will be understood by those skilled arts that various changes therein may be affected in form without departing from the spirit and scope of the invention as defined by the appended claims.

What is claimed is:

1. An apparatus for grounding a cable using a grounding member, said apparatus comprising:

a holder integrally formed at a predetermined portion of the cable for grounding the cable with the grounding member;

a grounding plate integrally mounted on the holder for making contact with the grounding member at the same time that the cable is secured to the grounding member by the holder; and a clamp protruding from the grounding plate so as to make contact with an ecdysis portion of the cable, thereby electrically connecting the cable to the grounding plate.

2. The apparatus as claimed in claim 1, wherein the clamp protrudes from the grounding plate in the direction of the cable and wraps around the ecdysis portion of the cable.

3. The apparatus as claimed in claim 1, wherein said clamp is formed integrally with said grounding plate.

4. The apparatus as claimed in claim 1, wherein the grounding plate comprises a first vertical portion inserted into the a coupling recess of the holder, a second vertical portion disposed opposite to the first vertical portion for making contact with a side surface of the holder, and a horizontal portion interconnecting the first and second vertical portions so that the grounding plate is assembled to the holder.

5. The apparatus as claimed in claim 4, wherein the clamp protrudes from the second vertical portion in the direction of the cable and wraps around the ecdysis portion of the cable.

6. The apparatus as claimed in claim 1, further comprising a contracting tube for preventing the clamp from shorting with other components.

7. The apparatus as claimed in claim 6, wherein said contacting tube is disposed adjacent to and in contact with said clamp.

8. The apparatus as claimed in claim 1, wherein the holder has a coupling recess formed at respective side surfaces thereof, the coupling recess being engaged with a receiving groove formed on the grounding member so that the cable is secured to the grounding member.

9. The apparatus as claimed in claim 8, wherein the grounding plate comprises a first vertical portion inserted into the coupling recess, a second vertical portion disposed opposite to the first vertical portion for making contact with a side surface of the holder, and a horizontal portion interconnecting the first and second vertical portions so that the grounding plate is assembled to the holder.

10. The apparatus as claimed in claim 9, wherein the clamp protrudes from the second vertical portion in the direction of the cable and wraps around the ecdysis portion of the cable.

11. An apparatus for grounding a cable using a grounding member, said apparatus, comprising:

a holder integrally formed at a predetermined portion of the cable for grounding the cable with the grounding member; and a grounding plate integrally mounted on the holder for making contact with the grounding member at the same time that the cable is secured to the grounding member by the holder;

wherein the holder has a coupling recess formed at respective side surfaces thereof, the coupling recess being engaged with a receiving groove formed on the grounding member so that the cable is secured to the grounding member.

12. The apparatus as claimed in claim 11, wherein the grounding plate comprises a first vertical portion inserted into the coupling recess, a second vertical portion disposed opposite to the first vertical portion for making contact with a side surface of the holder, and a horizontal portion interconnecting the first and second vertical portions so that the grounding plate is assembled to the holder.

13. The apparatus as claimed in claim 12, further comprising a clamp protruding from the second vertical portion in the direction of the cable and wrapping around an ecdysis portion of the cable.

14. The apparatus as claimed in claim 13, wherein said clamp is formed integrally with said grounding plate.

15. The apparatus as claimed in claim 13, further comprising a contracting tube for preventing the clamp from shorting with other components.

16. The apparatus as claimed in claim 15, wherein said contracting tube is disposed adjacent to and in contact with said clamp.

17. The apparatus as claimed in claim 11, further comprising a clamp protruding from the grounding plate in the direction of the cable and wrapping around an ecdysis portion of the cable.

18. The apparatus as claimed in claim 17, wherein said clamp is formed integrally with said grounding plate.

19. The apparatus as claimed in claim 17, further comprising a contracting tube for preventing the clamp from shorting with other components.

20. The apparatus as claimed in claim 19, wherein said contracting tube is disposed adjacent to and in contact with said clamp.

21. An apparatus for grounding a cable connected to an electronic appliance having a grounding member, said apparatus comprising:

a holder integrally formed at a predetermined portion of the cable for grounding the cable with the grounding member;

a grounding plate integrally mounted on the holder for making contact with the grounding member at the same time that the cable is secured to the grounding member by the holder; and a clamp protruding from the grounding plate so as to make contact with an ecdysis portion of the cable, thereby electrically connecting the cable to the grounding plate.

22. The apparatus as claimed in claim 21, wherein the holder has a coupling recess formed at respective side surfaces thereof, the coupling recess being engaged with a receiving groove formed on the grounding member so that the cable is secured to the grounding member.

23. The apparatus as claimed in claim 21, wherein the clamp protrudes from the grounding plate in the direction of the cable and wraps around the ecdysis portion of the cable.

24. The apparatus as claimed in claim 21, wherein said clamp is formed integrally with said grounding plate.

25. The apparatus as claimed in claim 21, wherein the holder has a coupling recess formed therein and has a side surface, and wherein the grounding plate comprises a first vertical portion inserted into the coupling recess of the holder, a second vertical portion disposed opposite to the first vertical portion for making contact with the side surface of the holder, and a horizontal portion interconnecting the first and second vertical portions so that the grounding plate is assembled to the holder.

26. The apparatus as claimed in claim 25, wherein the clamp protrudes from the second vertical portion in the direction of the cable and wraps around the ecdysis portion of the cable.

27. The apparatus as claimed in claim 21, further comprising a contracting tube for preventing the clamp from shorting with other components.

28. The apparatus as claimed in claim 27, wherein said contacting tube is disposed adjacent to and, in contact with, said clamp.

29. An apparatus for grounding a cable connected to an electronic appliance having a grounding member in which a receiving groove is formed, said apparatus comprising:

a holder integrally formed at a predetermined portion of the cable for grounding the cable with the grounding member; and a grounding plate integrally mounted on the holder for making contact with the grounding member at the same time that the cable is secured to the grounding member by the holder;

wherein the holder has a coupling recess formed at respective side surfaces thereof, the coupling recess being engaged with the receiving groove formed on the grounding member so that the cable is secured to the grounding member.

30. The apparatus as claimed in claim 29, wherein said holder has a side surface, and wherein the grounding plate comprises a first vertical portion inserted into the coupling recess, a second vertical portion disposed opposite to the first vertical portion for making contact with the side surface of the holder, and a horizontal portion interconnecting the first and second vertical portions so that the grounding plate is assembled to the holder.

31. The apparatus as claimed in claim 30, wherein said clamp is formed integrally with said grounding plate.

32. The apparatus as claimed in claim 29, further comprising a clamp protruding from the grounding plate in the direction of the cable and wrapping around an ecdysis portion of the cable.

33. The apparatus as claimed in claim 32, further comprising a contracting tube for preventing the clamp from shorting with other components.

34. The apparatus as claimed in claim 33, wherein said contracting tube is disposed adjacent to and in contact with said clamp.

* * * * *